United States Patent [19]

Sekiya et al.

[11] 4,096,412

[45] Jun. 20, 1978

[54] DRIVER CIRCUIT FOR ELECTROCHROMIC DISPLAY DEVICE

[75] Inventors: Fukuo Sekiya; Heihachiro Ebihara; Misao Uchino; Katsuo Nishimura; Takanori Nanya, all of Tokorozawa, Japan

[73] Assignee: Citizen Watch Company, Limited, Tokyo, Japan

[21] Appl. No.: 709,111

[22] Filed: Jul. 27, 1976

[30] Foreign Application Priority Data

| | | |
|---|---|---|
| Aug. 1, 1975 | Japan | 50-94005 |
| Oct. 31, 1975 | Japan | 50-131002 |
| Nov. 5, 1975 | Japan | 50-132674 |

[51] Int. Cl.[2] ..... H05B 37/2

[52] U.S. Cl. ..... 315/169 R; 315/169 TV; 340/166 EL; 58/50 R

[58] Field of Search ..... 315/169 R, 169 TV; 340/324 M, 166 EL, 173 PL; 350/160 LC; 58/50 R; 313/500, 510

[56] References Cited

U.S. PATENT DOCUMENTS

| | | | |
|---|---|---|---|
| 3,714,867 | 2/1973 | Dargent | 350/160 LC |
| 3,833,833 | 9/1974 | Nelson | 315/169 TV |
| 3,940,755 | 2/1976 | Shutoh | 315/169 TV |

OTHER PUBLICATIONS

Signetics: Integrated Circuits-*Digital, Linear, Mos,* 1972, pp. 7-8, FIG. 10(*c*).

*Primary Examiner*—Maynard R. Wilbur
*Assistant Examiner*—Lawrence Goodwin
*Attorney, Agent, or Firm*—Holman & Stern

[57] ABSTRACT

A driver circuit for an electrochromic display device having segment electrodes and a common electrode adapted to display information in response to a display information signal. The driver circuit comprises a storage means for generating first and second output signals delayed in phase from the display information signal. A bleaching signal generating means is responsive to the first output signal, and a coloration signal generating means is responsive to the second output signal. First and second switching means are coupled to receive a bleaching signal and a coloration signal, causing an electric current to flow each of the segment electrodes in directions to induce bleaching and coloration, respectively. An auxiliary signal is applied to the first and second switching means to cause a segment to remain in its previously activated state for an extended period of time.

21 Claims, 22 Drawing Figures

DRIVER CIRCUIT FOR ELECTROCHROMIC DISPLAY DEVICE

This invention relates in general to a driver circuit for an electrochromic display device and, more particularly, to a driver circuit for an electronic timepiece of the type employing an electrochromic display device.

Electrochromic display devices have been recently used in various applications, including electronic timepieces. These differ in certain important respects from the liquid crystal display devices which have also been used in such applications. With a liquid crystal device, it is necessary to apply a continuous potential or a high frequency pulse train to each display element which is to be actuated. With an electrochromic display device, however, application of a single voltage pulse, causing a momentary flow of current through the electrochromic display element, produces coloration of the element which persists for a period of minutes or days. Erasure of the coloration, referred to herein as bleaching, is normally performed by the application of opposite polarity to that which caused coloration. Since such a device exhibits a persistance or memory function and consumes substantial amounts of energy during the flow of an electric current, it has heretofore been proposed to cause an electric current to flow only through such display elements as actually perform a change-over between colored and bleached states during the driving operation. Since, however, the persistence of electrochromic display devices is limited, segments which are in the colored state gradually tend to become indistinct when a current does not flow through them for an extended period of time. Another problem is encountered in that when the surrounding external light strikes the electrochromic display device in an intense manner, the bleached segment gradually begins to color until it eventually attains a completely colored state. When the display segments are colored by an external stimulus in this fashion, an erroneous display is the result. This phenomenon can be reduced by utilizing a filter or the like although an excessively dark filter will also reduce the visibility of colored segment as well.

It is, therefore, an object of the present invention to provide a driver circuit for an electrochromic display device which is arranged to prevent indistinct displays of information.

It is another object of the present invention to provide a driver circuit for an electrochromic display device which is arranged to prevent the bleached segment from coloring due to an external light.

It is still another object of the present invention to provide a driver circuit for an electronic timepiece employing an electrochromic display device.

It is still another object of the present invention to provide a driver circuit for an electronic timepiece employing an electrochromic display device which driver circuit is simple in construction and highly reliable in operation.

These and other objects, features and advantages of the present invention will become more apparent from the foregoing description when taken in conjunction with the accompanying drawings, in which.

Before entering into detailed description of the present invention, it should be noted that while a driver circuit will be described as applied to an electronic timepiece the present invention is not limited thereto and may be applied to various other electronic devices such as calculators, etc.

Figure 1:
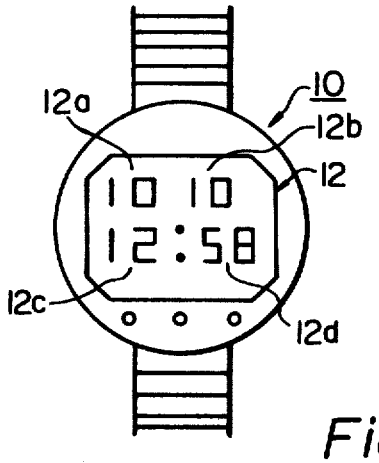
FIG. 1 is a plan view of an electronic timepiece equipped with a conventional driver circuit for an electrochromic display device.

Referring now to FIG. 1, there is schematically shown an electronic timepiece 10 equipped with a conventional driver circuit (not shown) for an electrochromic (EC) display device 12. The EC display device 12 includes a months display station **12*a*, a days display station 12*b*, an hours display station 12*c* and a minutes display station 12*d***, by which months, days, hours and minutes are displayed by coloring and bleaching seven segments in a selective manner.

Figure 2:
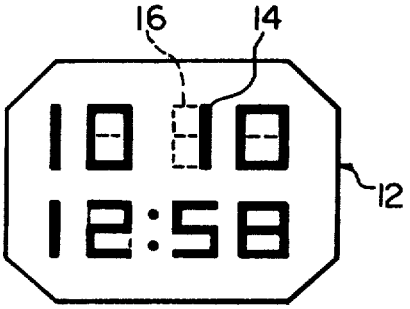
FIG. 2 is an expanded view of an electrochromic display device of FIG. 1.

FIG. 2 shows an expanded view of the EC display device 12, wherein a colored segment is depicted by a solid line 14 and a bleached segment by a broken line 16.

Figure 3:
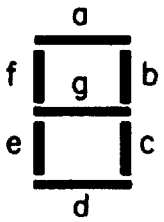
FIG. 3 shows an example of seven display segments forming parts of the display device of FIG. 2.
Figure 4:
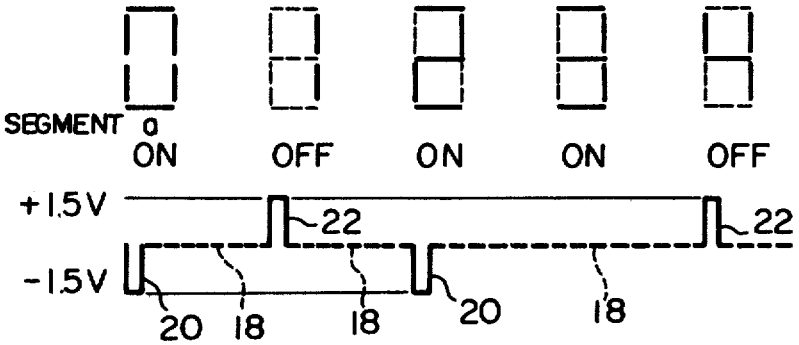
FIG. 4 shows a mode of coloring or bleaching the display segments using waveforms produced by a conventional driver circuit.

FIG. 3 illustrates seven display segments designated by *a, b, c, d, e, f* and *g*, and FIG. 4 shows a mode of driving seven segments by using waveforms produced by a conventional driver circuit.

In FIG. 4, the segment *a* is ON (colored) when the numeral "0" is displayed, OFF (bleached) when "1" is displayed, ON (colored) when "2" is displayed, ON (colored) when "3" is displayed, and OFF (bleached) when "4" is displayed. When the numeral "0" is displayed, a normally open state 18 prevails following the application of a −1.5 volt pulse 20 which has induced the colored state, and the persistence of the EC display device 12 allows the ON (colored) state to continue. When the numeral "1" is displayed, the segment *a* is brought to an OFF (bleached) state when a +1.5 volt pulse 22 for bleaching the segment is applied, whereafter the normally open state 18 once again prevails. However, when the OFF (bleached) state continues for an extended period of time, the ON (colored) state gradually begins due to the influence of the surrounding light. For the numeral "2", a −1.5 volt pulse 20 is applied to color segment *a* which continues to color for display of the numeral "3" during the normally open state 18. A +1.5 volt pulse 22 is applied for display of the numeral "4".

Figure 5:
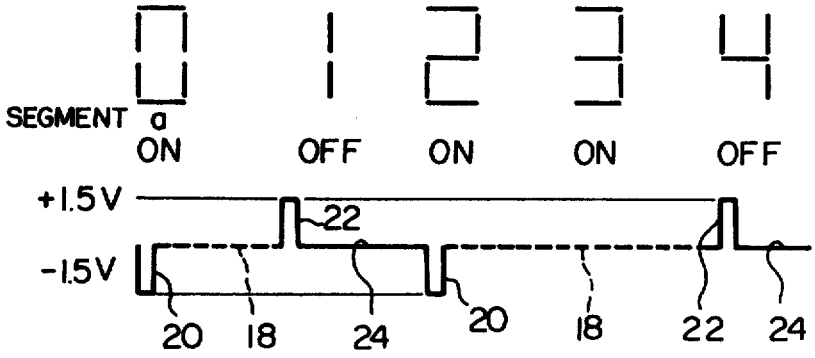
FIG. 5 shows a mode of coloring or bleaching the display segments using waveforms produced in accordance with the present invention.

FIG. 5 illustrates a mode of driving the display segments in accordance with the present invention which obviates the coloring effect of the surrounding light. As in FIG. 4, the display segment *a* is brought to the OFF (bleached) state following the application of the bleaching pulse 22. However, immediately after the application of pulse 22 the segment no longer to be displayed is short-circuited and a normally closed state 24 results during which the accumulation of electrical charges on EC display device 12 due to the influence of the surrounding light is prevented, thereby eliminating the reappearance of the colored state.

Figure 6:
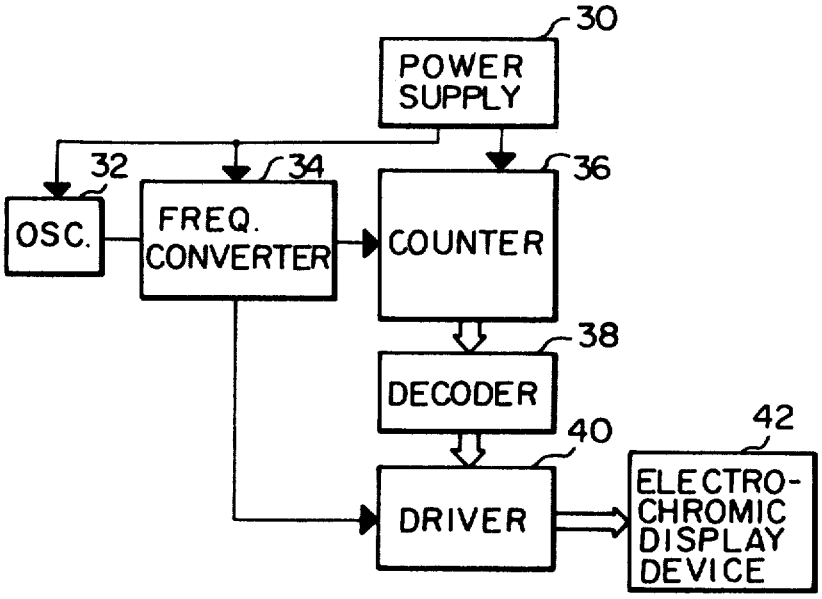
FIG. 6 is a block diagram of a preferred embodiment of an electronic timepiece according to the present invention.

FIG. 6 shows a block diagram of a preferred embodiment of an electronic timepiece to achieve the above concept. As shown, the electronic timepiece comprises a power supply 30 such as a battery, an oscillator circuit 32 to provide a high frequency output signal, and a frequency converter 34. In frequency converter 34, the high frequency output signal is frequency divided to produce a standard output signal of one pulse per second. This output is applied to a time counter 36, wherein the seconds signal is counted to produce minutes data, the minutes are counted to produce hours data, the hours are counted to provide days data, and the days are counted to provide month data. The data outputs from the time counter 36 are applied to a decoder 38, by which the data outputs are converted to seven segment code signals. These signals are applied to a driver circuit 40, which is responsive to a clock signal from the frequency converter 34 to generate drive signals to drive an electrochromic display device 42.

Figure 7:
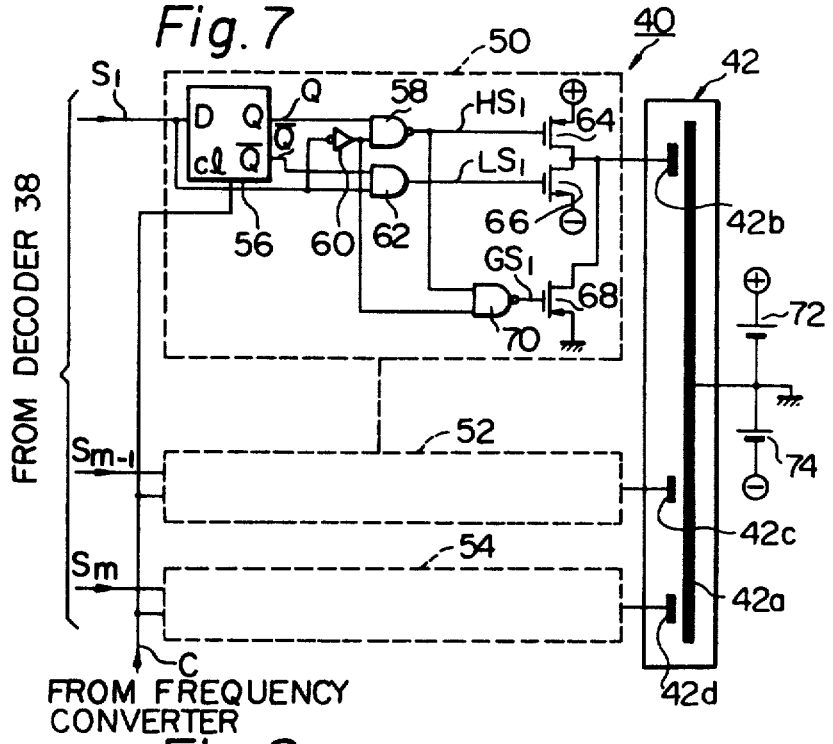
FIG. 7 is a preferred embodiment of a driver circuit shown in FIG. 6.

In FIG. 7, the driver circuit 40 comprises driver blocks 50, 52 and 54 having inputs coupled to the decoder 38 and outputs coupled to segment electrodes **42*b*, 42*c* and 42*d*, respectively. The driver block 50 comprises a latch circuit 56 for storing a display information signal from the decoder 38 and generating an output signal delayed in phase from the display information signal. The latch circuit has the data terminal coupled to the decoder 38 to receive a display information signal $S_1$ therefrom. The clock terminal of the latch circuit 56 is coupled to the frequency converter 34 to receive a clock signal C therefrom. The Q output of the latch circuit 56 is coupled to one input of a NAND gate 58 which serves as a bleaching signal generating means, whose another input is coupled through an inverter 60 to the decoder 38, to generate a bleaching signal. The $\overline{Q}$ output of the latch circuit 56 is coupled to one input of an AND gate 62 which serves as a coloration signal generating means, whose another input is coupled to the decoder 38, to generate a coloration signal. The output of the NAND gate 58 is coupled to a first switching means 64, and the output of the AND gate 62 is coupled to a second switching means 66. The first switching means 64 comprises a P-channel metal oxide semiconductor field-effect transistor (P-channel MOSFET) having its source terminal coupled to the positive potential side of the power supply. The second switching means 66 comprises an N-channel metal oxide semiconductor field-effect transistor (N-channel MOSFET) having its source terminal coupled to the negative potential side of the power supply. The drain terminals of the MOSFETs 64 and 66 are coupled together and connected to the segment electrode 42*b*. The driver block 50 further comprises means for generating an auxiliary signal to cause the segment no longer to be displayed to remain in its previously activated state, i.e., in the bleached state for an extended period of time. The auxiliary signal generation means comprises switching means 68 coupled to the segment electrode 42*b*, and a NAND gate 70 serving as a detecting means for detecting a bleaching indicative state of the signal $S_1$ to generate an auxiliary signal. The switching means 68 comprises a P-channel MOSFET having its gate terminal coupled to the output of NAND gate 70, whose inputs coupled to the output of the inverter 60 and the output of the NAND gate 58 to generate a short-circuiting signal. The source terminal of the P-channel MOSFET 68 is grounded so that when the P-channel MOSFET 68 is rendered conductive in response to the auxiliary signal the segment electrode 42*b* and the common electrode 42*a* are caused to be short-circuited to maintain the segment in its bleached state for an extended period of time. To this end, the drain terminal of the P-channel MOSFET 68 is coupled to the segment electrode 42*b*. The common electrode 42*a* is coupled between the negative terminal of a battery 72 and the positive terminal of a battery 74** and connected to ground.

The operation of the latch circuit 56 is exemplified in the following Table:

Table

| cl | D | Qn | $\overline{Qn}$ |
|---|---|---|---|
| H | H | H | L |
| H | L | L | H |
| L | X | Qn−1 | $\overline{Qn-1}$ |

Figure 8:
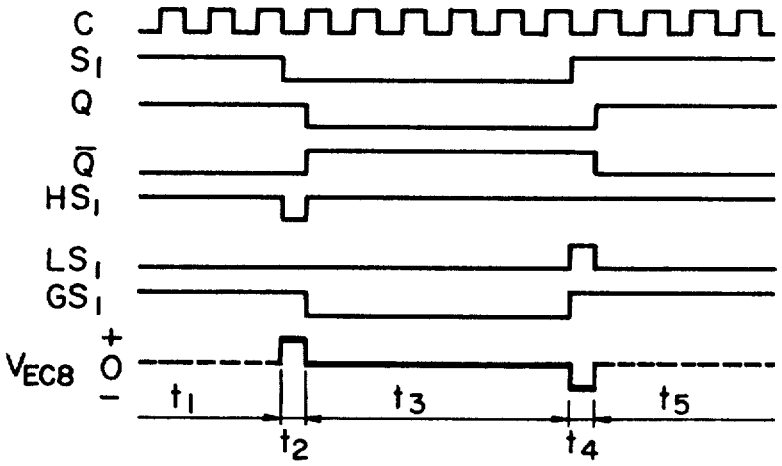
FIG. 8 is a timing chart illustrating the operation of the circuit shown in FIG. 7.

In operation, the display information signal $S_1$ is applied to the data terminal of the latch circuit 56 and the clock signal C to the clock terminal. As can be seen in FIG. 8, the output signal Q from the latch circuit 56 lags behind the signal $S_1$ by an interval equivalent to one-half the cycle of the clock signal C; output signal Q is the inverse of the signal Q. Signal $S_1$ when at a high logic level indicates that a segment is to be colored; a low logic level indicates bleaching. Each gate circuit employs these signals to produce signals $HS_1$, $LS_1$ and $GS_1$. Signal $HS_1$ is a negative pulse equivalent to one-half the cycle of the clock signal C and is produced synchronously with the falling edge of signal $S_1$. When signal $HS_1$ attains a low logic level, P-channel MOSFET 64 conducts. As a result, segment electrode **42*b* is connected to the positive potential and a current flows through the segment in a direction which induces the bleached state. Signal $LS_1$ is a positive pulse equivalent to one-half the cycle of the clock signal C and is produced synchronously with the rising edge of signal $S_1$. When signal $LS_1$ attains a high logic level, N-channel MOSFET 66 conducts. As a result, segment electrode 42b is connected to the negative potential and a current flows through the segment in a direction which induces the colored state. Signal $GS_1$ attains a low logic level synchronously with the rising edge of signal $HS_1$ and remains at the low logic level during the interval that signal $S_1$ is at the low level. When signal $GS_1$ is at a low logic level, P-channel MOSFET 68 conducts. As a result, the segment electrode 42b is connected to ground and is thus shorted to common electrode 42a. It therefore follows that the voltage impressed upon the segment electrode 42b assumes a waveform denoted by $V_{EC8}$ in FIG. 8. Here the broken line represents an OPEN state. During the interval $t_1$, the signal $S_1$ is at a high level and the segment is in a colored state. Segment electrode 42b is OPEN and the segment maintains the colored state due to its persistence. During interval $t_2$, a current is caused to flow in a direction to induce bleaching in order to change the displayed state from colored to bleached. During interval $t_3$, the segment electrode and common electrode are held at the same potential in order to inhibit the reappearance of the colored state due to the effect of the surrounding light. During interval $t_4$, a current is caused to flow in a direction to induce coloration in order to change the displayed state from bleached to colored. During interval $t_5$, segment electrode 42b is OPEN and the segment maintains the colored state due to its persistence. The driver blocks 52 and 54 are similar in circuit arrangement with the block 50** and, therefore, a detailed description of the same is herein omitted for the sake of simplicity of description.

Figure 9:
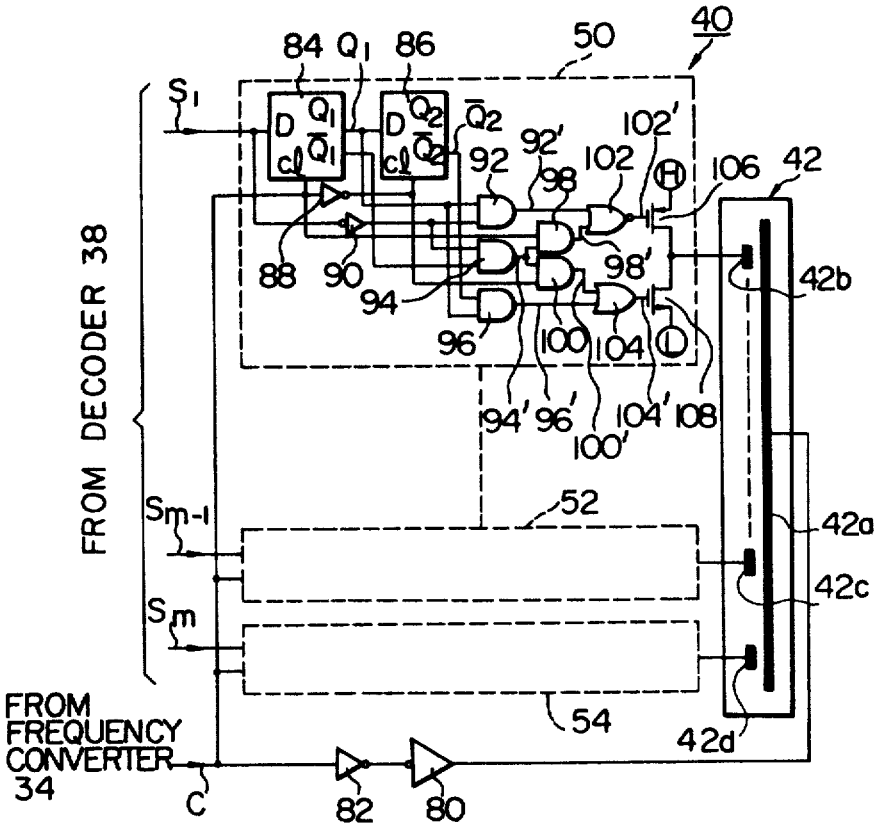
FIG. 9 is another preferred embodiment of a driver circuit shown in FIG. 6.

FIG. 9 shows another preferred embodiment of a driver circuit according to this invention wherein an EC display device is driven by means of a single power source. Here, the common electrode 42a is connected to the output of inverter 80. Since the input terminal of the inverter 80 is supplied with a clock signal C via inverter 82, the inverter 80 produces an output signal which is identical to the clock signal. Accordingly, the common electrode 42a is connected to the high potential side of the power source when the clock signal C is at a high level and to the low potential side when the clock signal C is at a low level. When the common electrode 42a is connected to the high potential side of the power source the segment electrode is also connected thereto; similarly, when the common electrode 42a is connected to the low potential side of the power source the segment electrode is connected thereto, whereby the segment electrode corresponding to the element which is not to be displayed is shorted to the common electrode and remains in its bleached state for an extended period of time.

In the illustrated embodiment of FIG. 9, the driver block 50 comprises latch circuits 84 and 86, which are identical in construction to those employed in FIG. 7, with display information signal $S_1$ applied to the data input terminal of latch circuit 84 and a clock signal C applied to the clock terminal. Output signal $Q_1$ from the latch circuit 84 is applied to the data input terminal of the latch circuit 86. A clock signal C is applied to the clock terminal of latch circuit 86 via an inverter 88. Output signal $Q_1$ and signal $S_1$ via inverter 90 are applied as inputs to the input terminals of AND gate 92 which generates a bleaching signal in response to the output signal $Q_1$ from latch circuit 84. Output signal $\overline{Q_1}$ and signal $S_1$ via inverter 90 are applied as inputs to AND gate 94 which forms part of an auxiliary signal generation means and serves as a detecting means for detecting a bleaching indicative state of the signal $S_1$. The auxiliary signal generation means further comprises AND gates 98 and 100, NOR gate 102 and OR gate 104. Output signal $Q_1$ and a signal $\overline{Q_2}$ are applied as inputs to AND gate 96 which generates a coloration signal in response to the output signal $\overline{Q_2}$ from latch circuit 86. An output signal from AND gate 94 and a clock signal C are applied as inputs to AND gate 98. An output signal from AND gate 94 and a clock signal C via inverter 88 are applied as inputs to AND gate 100. The output signals from AND gates 92 and 98 are applied as inputs to NOR gate 102, and the outputs of AND gates 96 and 100 are applied as inputs to OR gate 104. Segment electrode 42b is connectable to the high potential side of the power source through P-channel MOSFET 106 and to the low potential side of the power source through N-channel MOSFET 108. The output signal produced by NOR gate 102 is applied to the gate terminal of P-channel MOSFET 106, and the output signal produced by OR gate 104 is applied to the gate terminal of N-channel MOSFET 108.

Figure 10:
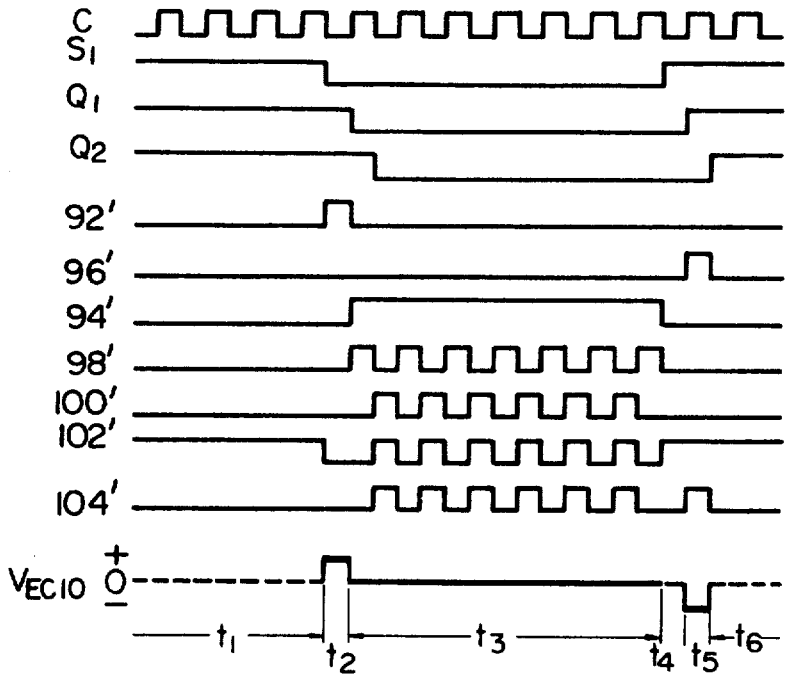
FIG. 10 is a timing chart illustrating the operation of the circuit shown in FIG. 9.

Signal $Q_1$ lags behind signal $S_1$ by an interval equivalent to one-half the cycle of the clock signal C, and signal $Q_2$ lags behind signal $Q_1$ by an interval which is also equivalent to one-half the cycle of the clock signal C. AND gates 92, 94, 96, 98 and 100, NOR gate 102 and OR gate 104 employ these signals to produce output signals respectively denoted by the signal waveforms 94', 94', 96', 98', 100', 102' and 104' shown in FIG. 10.

Signal 92' determines the timing for conduction of a current in such a direction as will induce a bleached state. Signal 96' determines the timing for conduction of a current in such a direction as will induce a colored state. Signal 94' determines the timing for short-circuiting of the segment electrode and common electrode. Signal 98' determines the timing for conduction of P-channel MOSFET 106 which initiates the short-circuiting function, and signal 100' determines the timing for conduction of N-channel MOSFET 108 which also serves to initiate the short-circuiting function. Since P-channel MOSFET 106 attains a conductive state when signal 102' is at a low level, segment electrode 42b is connected to the high potential side of the power supply. When signal 104' is at a high level, N-channel MOSFET 108 is brought to a conductive state so that segment electrode 42b is connected to the low potential side of the power supply. On the other hand, since the potential of the common electrode 42a and the clock signal C are in coincidence, the potential of segment electrode 42b with respect to the common electrode is represented by signal $V_{EC10}$.

During interval $t_1$, the segment is OPEN and a colored state is maintained. During interval $t_2$, a bleached state is attained since a current is caused to flow in such a direction. During interval $t_3$, the segment remains in the bleached state due to the short-circuited state. During interval $t_4$, the bleaches state continues to be maintained since the segment is OPEN. During interval $t_5$, the colored state is attained since a current is caused to flow in such a direction. During interval $t_6$, the segment is OPEN so that the colored state is maintained.

Figure 11:
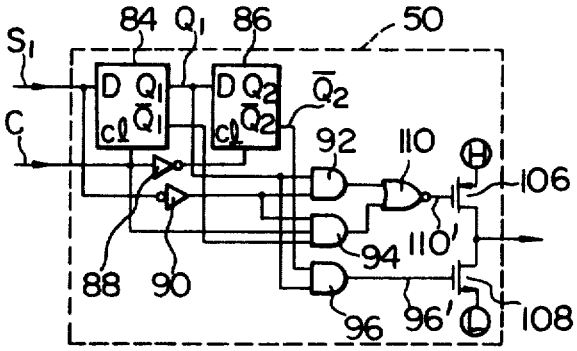
FIGS. 11 and 12 are modified forms of driver circuits in which elements which are not to be displayed are periodically short-circuited.
Figure 12:
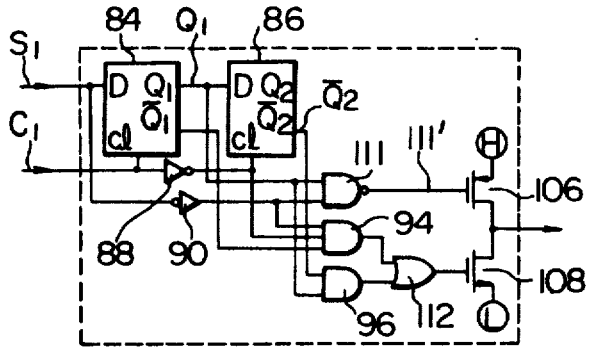
Figure 13:
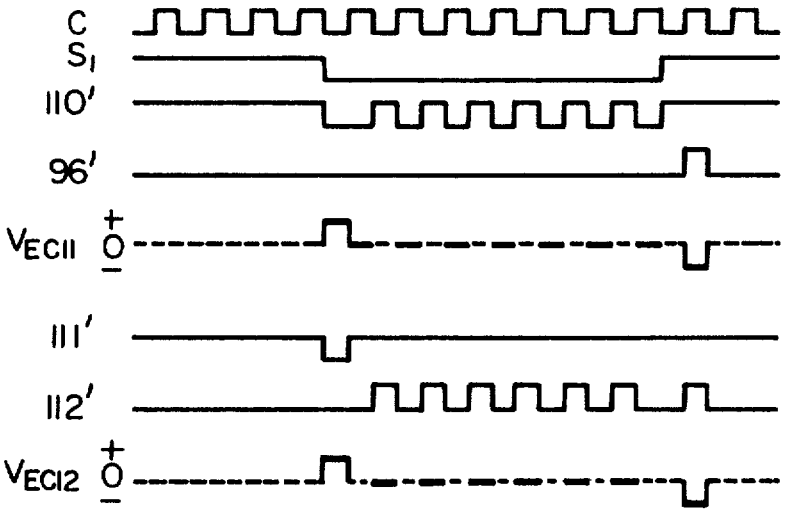
FIG. 13 is a timing chart illustrating the operation of the driver circuits shown in FIGS. 11 and 12.

FIGS. 11 and 12 illustrate modified forms of driver circuits in which elements not to be displayed are periodically short-circuited. FIG. 13 is the corresponding timing chart.

FIG. 11 shows a modified form of the driver circuit 50 shown in FIG. 9; all remaining driver blocks may be constructed as shown in FIG. 9. The difference between the circuit of FIG. 11 and the driver block of FIG. 9 resides in the fact that the output signal applied to the gate electrode of N-channel MOSFET 108 corresponds to the output signal produced by AND gate 96 shown in FIG. 9. The output signal produced by NOR gate 110 is represented by the signal waveform 110' shown in FIG. 13. This is equivalent to the output signal produced by NOR gate 102 of FIG. 9. The output signal produced by AND gate 96 is represented by signal waveform 96' which is equivalent to the output signal produced by AND gate 96 of FIG. 9. AS a result of employing these signals in the driving operation, the potential of the segment electrode with respect to the common electrode assumes the waveform denoted by $V_{EC11}$ in FIG. 13. It is readily apparent from signal $V_{EC11}$ that elements which are not to be displayed are periodically short-circuited.

FIG. 12 is another modified form of the circuit shown in FIG. 9, with the difference residing in the fact that the output signal applied to the gate electrode of P-channel MOSFET 106 is the inverse of the output signal produced by AND gate 92 shown in FIG. 9. The output signal produced by NAND gate 111 is represented by the signal waveform 111'0 shown in FIG. 13 which is the inverse of the output signal produced by AND gate 92 illustrated in FIG. 9. The output signal produced by OR gate 112 is represented by signal waveform 112' which is equivalent to the output signal produced by OR gate 104 of FIG. 9. As a result of employing these signals in the driving operation, the potential of the segment electrode with respect to the common electrode assumes the waveform denoted by $V_{EC12}$ in FIG. 13. It is readily apparent from signal $V_{EC12}$ that element which are not to be displayed are periodically shorted as was identically the case as illustrated by FIG. 11.

The circuits as constructed in FIGS. 11 and 12, as opposed to the circuit shown in FIG. 9, allow the number of component elements employed in the driver circuit to be reduced.

It will thus be understood that the driver circuits as proposed by the present invention permit display elements which are not to be displayed to be short-circuited and prevent the accumulation of unnecessary electrical charges due to the affect of the surrounding external light. This in turn inhibits an erroneous display since such display elements as are not desired to be displayed are maintained in a bleached state. The present invention is thus capable of providing remarkable effects and is well suited for application in electronic timepieces.

Figure 14:
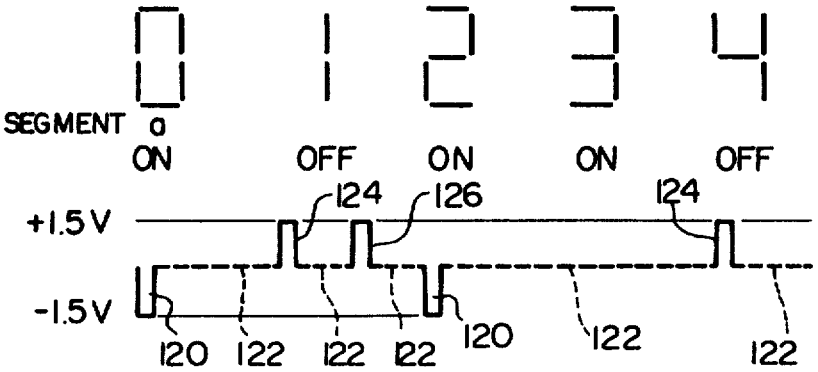
FIG. 14 shows another mode of coloring or bleaching the display segments using waveforms produced in accordance with the present invention.

FIG. 14 shows another mode of driving display elements to prevent the coloration of the display elements due to the influence of the external light. In FIG. 14, the segment *a* is ON (colored) when the numeral "0" is displayed, OFF (bleached) when "1" is displayed, ON (colored) when "2" is displayed, ON (colored) when "3" is displayed, and OFF (bleached) when "4" is displayed. When the numeral "0" is displayed, a normally open state 122 prevails following the application of a −1.5 volt pulse 120 which has induced the colored state, and the persistence of the EC display element allows the ON (colored) state to continue. When the numeral "1" is displayed, the segment *a* is brought to an OFF (bleached) state when a +1.5 volt pulse 124 for bleaching the segment *a* is applied, whereafter the normally open state 122 once again prevails. However, when the OFF (bleached) state continues for an extended period of time, the ON (colored) state gradually begins to reappear due to the influence of the surrounding light. To overcome this problem, following the application of the pulse 124 which induces the bleached state, an additional pulse 126 causes a voltage to be applied to the non-displayed elements in a direction as will hold them in a bleached state. Thus, the accumulation of electrical charges on the EC display device due to the influence of the surrounding light or other such stimuli is prevented. For the numeral "2", a −1.5 volt pulse 120 is applied to color segment *a* which continues to conduct for display of the numeral "3" during the normally open state 122. A +1.5 volt pulse 124 is then applied for display of the numeral "4".

Figure 15:
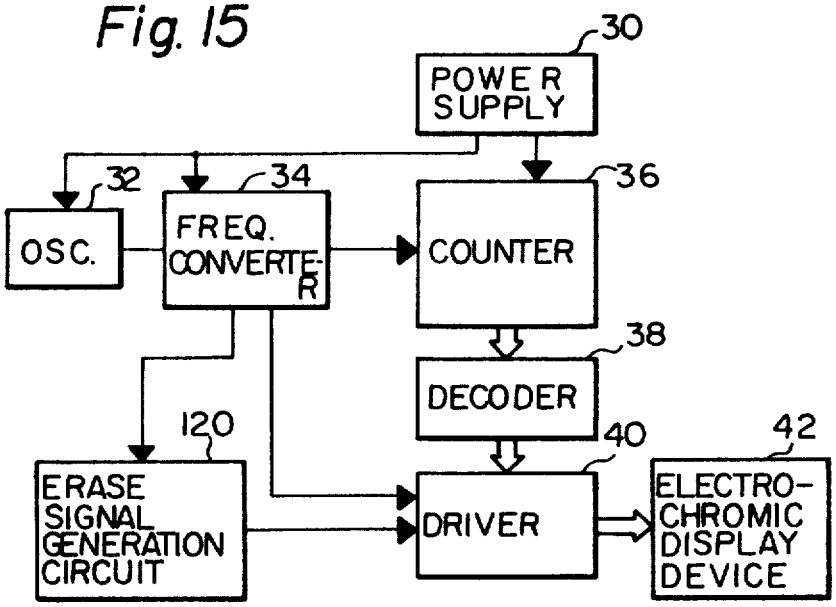
FIG. 15 is a block diagram of another preferred embodiment of an electronic timepiece according to the present invention.

FIG. 15 illustrates a block diagram of an electronic timepiece to achieve the above concept and the like or corresponding component parts are assigned by the same reference numerals as those used in FIG. 6. This embodiment differs from that of FIG. 6 in that a driver circuit 40 is arranged to generate a pulse to cause a voltage to be applied to the non-displayed elements in a direction to maintain them in a bleached state in response to an erase signal generated by an erase signal generation circuit 120.

Figure 16:
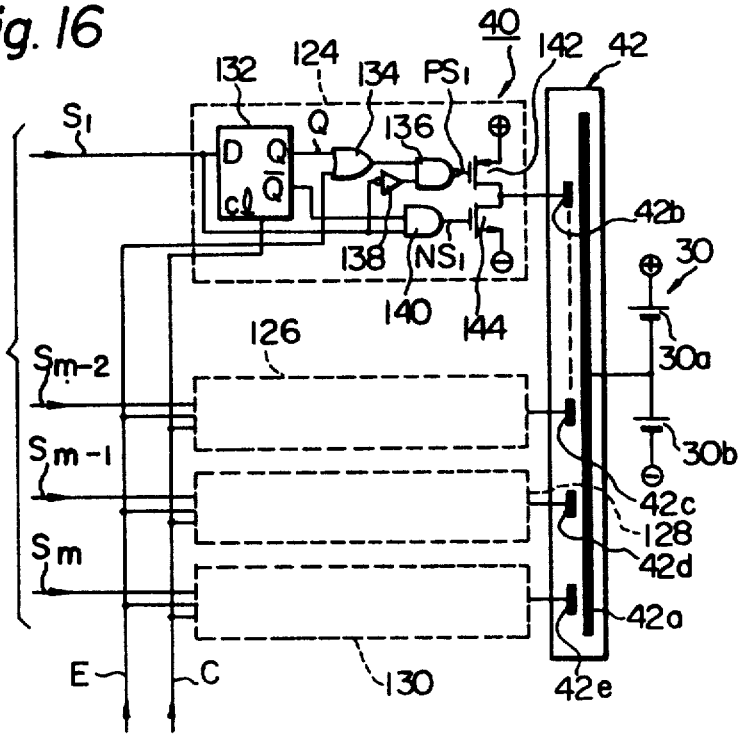
FIG. 16 is a preferred embodiment of a driver circuit shown in FIG. 15.

FIG. 16 shows a preferred embodiment of a driver circuit 40 shown in FIG. 15. In FIG. 16, the driver circuit 40 comprises driver blocks 124, 126, 128 and 130 having inputs coupled to the decoder 38 to receive display information signals $S_1$, $S_{m-2}$, $S_{m-1}$ and $S_m$ and outputs coupled to segment electrodes **42*b*, 42*c*, 42*d* and 42*e* of the EC display device 42, respectively. The common electrode 42*a* of the EC display device is coupled between the negative terminal of a battery 30*a* and the positive terminal of a battery 30*b***.

The driver block 124 comprises a latch circuit 132 having its data terminal coupled to receive a display information signal $S_1$ and a clock terminal coupled to the frequency converter 34 to receive a clock signal C therefrom. The Q output of the latch circuit 132 is coupled to one input of an OR gate 134 serving as an auxiliary signal generation means, whose another input is coupled to the erase signal generation circuit 120 to receive an erase signal E therefrom. The OR gate 134 is responsive to the erase signal to generate an auxiliary signal to maintain the segment to its previously bleached state for an extended period of time. To this end, an output of the OR gate 134 is coupled to one input of a NAND gate 136 whose other input is coupled to an output of an inverter 138 to receive an inverted display information signal. The $\overline{Q}$ output of the latch circuit 132 is coupled to one input of an AND gate 140, whose other input is coupled to receive the display information signal. An output of the NAND gate 136 is coupled to the gate terminal of P-channel MOSFET 142, and an output of the AND gate 140 is coupled to the gate terminal of N-channel MOSFET 144. The source terminal of the P-channel MOSFET 142 is coupled to the positive potential side of the power supply, while the source terminal of the N-channel MOSFET 144 is coupled to the negative potential side of the power supply. The drain terminals of the MOSFETs 142 and 144 are coupled together and connected to the segment electrode **42*b***.

Figure 17:
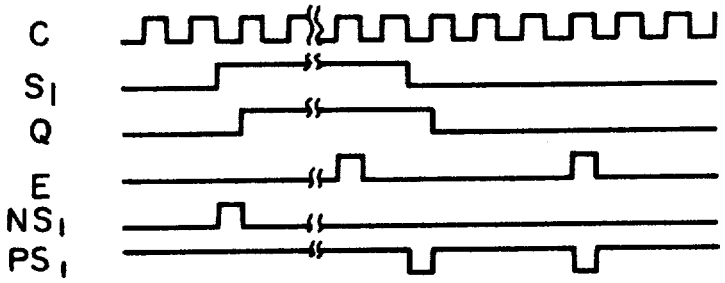
FIG. 17 is a timing chart illustrating the operation of the circuit shown in FIG. 16.

Signal $S_1$ is applied to the data terminal of the latch circuit 132, which produces an output signal Q as shown in FIG. 17. The OR gate 134 is provided with output signal Q produced by the latch circuit 132 and with an erase signal E as inputs. The erase signal E is an additional signal provided in accordance with this invention and determines the timing for the application of a voltage to an element which is not to be displayed, i.e., to a segment which is to be bleached, the voltage being applied in a direction as will bleach the segment. The output signal from the OR gate 134 and a signal which is the inverse of the display information signal $S_1$ are applied to NAND gate 136. Signal $S_1$ and the output signal $\overline{Q}$ produced by the latch circuit 132 are applied to AND gate 140. Output signal $PS_1$ produced by the NAND gate 136 is applied to the gate electrode of P-channel MOSFET 142 which is turned ON when the signal $PS_1$ is at a low logic level. This causes a positive voltage to be impressed upon segment electrode **42*b* so that the segment attains a bleached state. Output signal $NS_1$ produced by AND gate 140 is applied to the gate electrode of N-channel MOSFET 144 which is turned ON when the signal $NS_1$ is at a high logic level. This causes a negative voltage to be impressed upon segment electrode 42*b*** so that the segment attains a colored state.

As can be seen in FIG. 17, the output signal Q from the latch circuit 132 lags behind the signal $S_1$ by an interval equivalent to one-half the cycle of the clock signal C. As a result the signal $NS_1$ and signal $PS_1$ assume the waveforms as shown in FIG. 17. Signal $NS_1$ is raised to a high logic level for a short period of time when the signal $S_1$ changes from a low to a high logic level, whereby N-channel MOSFET 144 is turned ON so that a voltage is applied in a direction as will induce the colored state. Signal $PS_1$ is lowered to a low logic level for a short period of time when signal $S_1$ changes from a high to a low logic level. In this case, signal $PS_1$ is also lowered to a low logic level when the erase signal E attains a high logic level while signal $S_1$ is at a low logic level and the segment is to be in a bleached state. Accordingly, at either of such times when signal $PS_1$ is lowered to a low logic level, P-channel MOSFET 142 is turned ON so that a voltage is applied in a direction as will induce a bleached state. When signal $S_1$ is at a high level, signal $PS_1$ is unaffected even if an erase signal E is present as an output. In this manner the erase signal E causes a voltage to be impressed upon the undisplayed element in a direction as will maintain a bleached state, thereby to prevent the accumulation of electric charges due to the surrounding light or other such stimuli. The pulse width of the erase signal E may be chosen to suit the characteristics of the particular EC display device. In addition, the erase signal E may be a periodically produced pulse generated once per hour or a signal produced by the manipulation of an external control member. In a case where such a control member is employed, the observer can freely generate an erase signal as the state of the display demands. It has also been considered to apply an erase signal E, which is a relatively low voltage, in a direction as will induce a bleached state when signal $S_1$ is at a low level. The drive blocks 126, 128 and 130 are similar in circuit arrangement with the block 124 and, therefore, a detailed description of the same is omitted.

Figure 18:
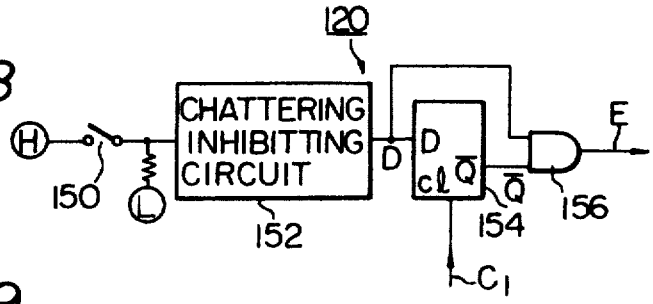
FIG. 18 is a preferred example of a circuit for generating an erase signal by means of an external control member.
Figure 19:
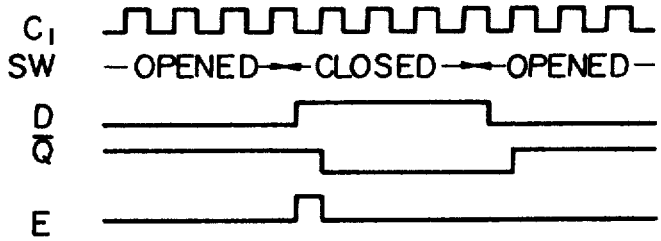
FIG. 19 is a timing chart illustrating the operation of the circuit shown in FIG. 18.

FIG. 18 illustrates a preferred example of an erase signal generation circuit 120 arranged to generate an erase signal by means of an external control member, and FIG. 19 is the corresponding timing chart.

When an external control member such as switch 150 is placed in a position denoted by SW in FIG. 19, chattering inhibiting circuit 152 produces a control signal denoted by waveform D. Latch circuit 154 is similar to the one employed in FIG. 16 and operates in an identical manner. Signal $\overline{Q}$ lags behind signal D by an interval equivalent to one-half the cycle of the clock signal $C_1$ and, when applied as an input to AND gate 156 along with signal D, enables an erase signal E to be produced. Closing switch 150 causes this erase signal to simultaneously attain a high level the duration of which is equivalent to one-half the cycle of the clock signal $C_1$. Preferably the clock signal utilized by the circuit of FIG. 18 is shorter in period than that used by the circuit illustrated in FIG. 16.

For cases where a single power source drive system is employed in which the common electrode of the EC display device is periodically connected through a switching element to the positive and negative potential sides of the power source, the erase signal may be generated by selecting such a timing as will connect the common electrode to the negative potential side of the power source.

With the arrangement mentioned above, such an external stimulus as the surrounding light does not induce coloration of bleached elements so that erroneous displays can be inhibited.

Figure 20:
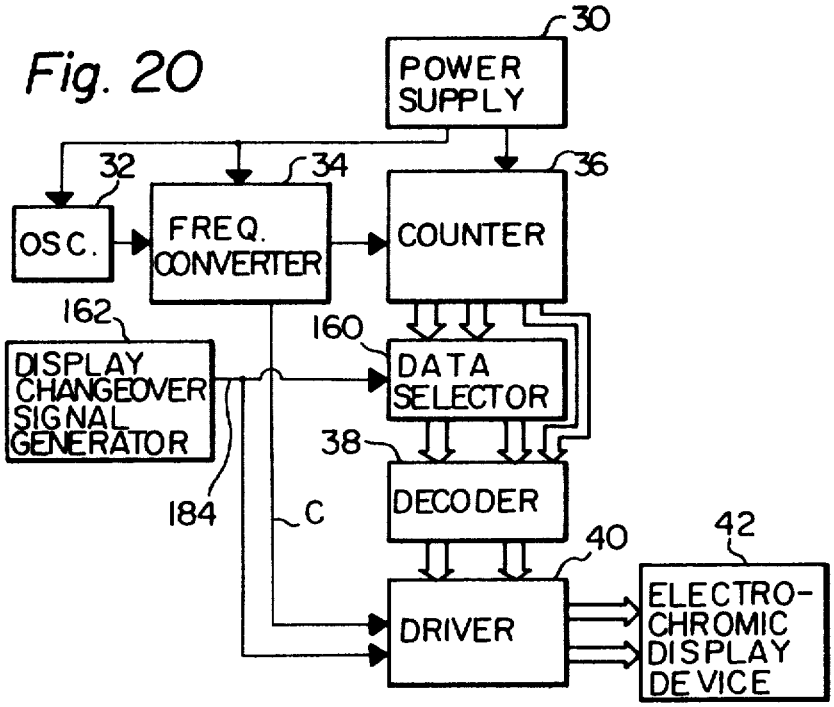
FIG. 20 is a block diagram of another preferred embodiment of an electronic timepiece according to the present invention.

Another preferred embodiment of an electronic timepiece is illustrated in FIG. 20, in which like or corresponding component parts are designated by the same reference numerals as those used in FIG. 6. In this illustrated embodiment, a data selector 160 is coupled between time counter 36 and decoder 38 to select data to be displayed in response to a display change-over signal produced by display change-over signal generator 162. The display change-over signal is also applied to driver circuit 40, which generates periodic coloration signals to hold a colored segment in a colored state for an extended period of time, thereby allowing indistinct displays to be prevented.

Figure 21:
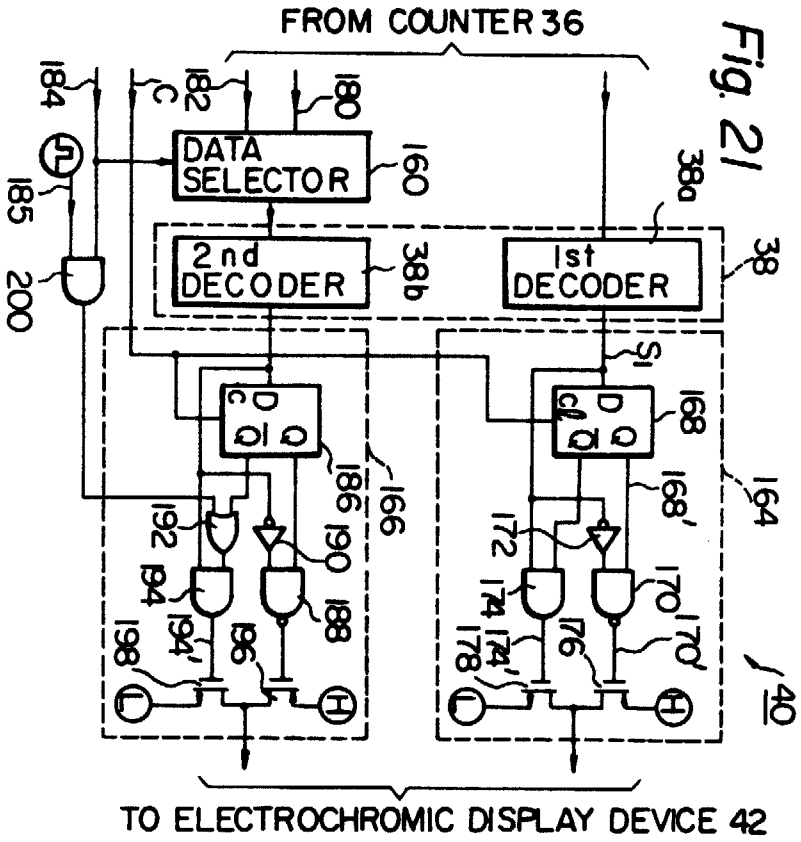
FIG. 21 is a preferred embodiment of a driver circuit shown in FIG. 20.

FIG. 21 shows a preferred example of a driver circuit 40 shown in FIG. 20. In FIG. 21, the driver circuit 40 is shown as comprising driver blocks 164 and 166, and the decoder 38 is shown as comprising first and second decoders **38*a* and 38*b*. The driver block 164 comprises a latch circuit 168 serving as a delay circuit. The data terminal of the latch circuit 168 is coupled to the first decoder 38*a* where the time information signal from the time counter 36 is converted to a display information signal. The clock terminal of the latch circuit 168 is connected to receive a clock signal from the frequency converter 34. The Q output of the latch circuit 168 is coupled to one input of a NAND gate 170, whose another input is coupled to receive the display information signal via an inverter 172. The $\overline{Q}$ output of the latch circuit 168 is coupled to one input of an AND gate 174 whose other input is coupled to receive the display information signal. The gate terminal of N-channel MOSFET 178 is connected to the output of AND gate 174, and the source terminal is connected to the low potential side of the power source. The gate terminal of P-channel MOSFET 176 is connected to the output of NAND gate 170, the source terminal is connected to the high potential side of the power source, and the drain terminal is connected to the drain terminal of N-channel MOSFET 178 so as to serve as the output terminal of driver circuit 164 which is further connected to the segment electrode of the electrochromic display device 42. Data selector 160 is arranged to perform such combined functions as an hours and months display, a days and minutes display, and other such combinations. Information applied as an input via lines 180 and 182 is selectively passed and fed to 2nd decoder 38***b* in response to a display change-over signal applied through line 184. This display change-over signal is generally controlled by an external control member. Driver block 166 comprises a latch circuit 186, a NAND gate 188, an inverter 190, and an AND gate 194. The driver block 166 further comprises an OR gate 192 serving as an auxiliary signal generation means to generate an auxiliary signal to maintain the colored segment in its previously activated state. The $\overline{Q}$ output of latch circuit 186 is connected to one input of OR gate 192, the other input of which is connected to the output of AND gate 200 which generates a control signal in response to the display change-over signal and a periodic conduction signal. The output of OR gate 192 is connected to one input of AND gate 194. The inputs of AND gate 200 are provided with the display change-over signal and the periodic conduction signal. Decoders 38*a* and 38*b* produce display information signals for each segment electrode of the electrochromic display device and either driver circuit 164 or driver circuit 166 are provided for each individual display information signal although the other corresponding circuits are not shown in FIG. 21 for the sake of simplicity. In operation, a signal denoted by waveform 168' in FIG. 22 appears at the output terminal of latch circuit 168 when a display information signal denoted by waveform $S_1$ and a delay timing signal or clock signal denoted by waveform C are respectively applied to the data terminal and the clock terminal. Signal 168' lags behind the display information signal $S_1$ by an interval equivalent to one-half the cycle of signal C. A change in state of the display information signal $S_1$ is synchronized with the falling edge of signal C and lags slightly behind it in time. It may readily be understood from the timing chart of FIG. 22 that a signal denoted by waveform 170' appears at the output of NAND gate 170 and a signal denoted by waveform 174' appears at the output of AND gate 174 when signal 168' is produced at the output terminal of latch circuit 168. Signal 170' is a negative pulse produced whenever the display information signal changes from a high to a low logic level, and signal 174' is a positive pulse produced whenever the display information signal changes from a low to high logic level. When the display information signal changes from a low to a high logic level, the output of AND gate 174 is raised to a high level for a short period of time which turns N-channel MOSFET 178 ON. This in turn connects the segment electrode of the electrochromic display device to the low potential side of the power source so as to induce a colored state. The electrochromic display device conducts for a period of time as regulated by the pulse width of the output signal produced by AND gate 174. The colored state is maintained by the persistence of the electrochromic display device after the current has ceased flowing.

When the display information signal changes from a high to a low logic level, the output of NAND gate 170 is lowered to a low level for a short period of time which turns P-channel MOSFET 176 ON. This in turn connects the segment electrode of the electrochromic display device to the high potential side of the power source so as to induce a bleached state.

In order to reduce the number of elements of the circuit shown in FIG. 21, a drive signal having a width equivalent to the delay of the display information signal is produced. This signal is then applied to the electrochromic device which conducts in conformance to the pulse width.

Thus in driver circuit 164 current flows through the electrochromic display device only when the display information signal changes state. Consequently, no current will flow through display elements other than those for which a change-over in display is indicated. Driver circuit 166 is similar to driver circuit 164 with another function added; it possesses a function as will periodically cause a current to flow in a color-inducing direction through display elements which are in the colored state. When the display change-over signal is at a low logic level, the output of AND gate 200 attains a low level and driver circuit 166 operates exactly as does driver circuit 164. In other words, when the display change-over signal is at a low logic level the function which causes a current to periodically flow in a color-inducing direction through the display elements in the colored state is not employed. When the display change-over signal is at a high logic level, a periodic conduction signal appears at the output of AND gate 200. This signal is normally at a low level and is periodically made to attain a high level for a short period of time. When the output of AND gate 200 is thus at a high level, OR gate 192 produces a high level output. When the display information signal at this time is at a high level AND gate 194 produces a high level output, turning N-channel MOSFET 198 ON. As a result, a current flows in a color-inducing direction through the display elements driven by driver circuit 166. In other words, when display elements driven by driver circuit 166 are in the colored state and the display change-over signal is at a high logic level, a current flows periodically in a color-inducing direction.

Figure 22:
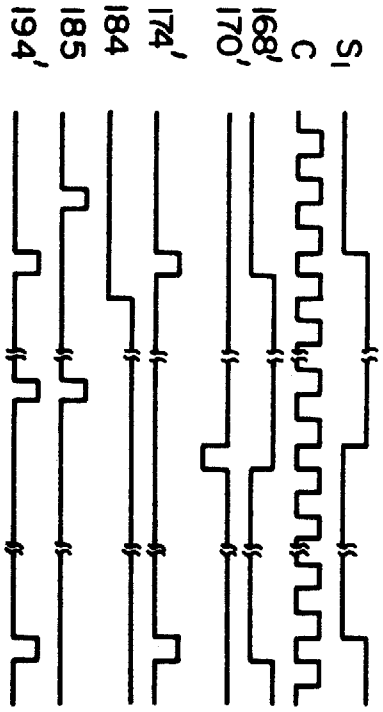
FIG. 22 is a timing chart illustrating the operation of the circuit shown in FIG. 21.

FIG. 22 shows the relationships between signals 184, 185 and 194', wherein signal 184 is a change-over signal, 185 a periodic conduction signal, and 194' the output signal produced by AND gate 194. Signal 194' when at a high level causes a current to flow in a color-inducing direction through the above-mentioned display elements. The period of the periodic conduction signal is determined by the persistence of the EC display device although the period should be at least one day long.

For driver circuits which do not include display change-over means, the periodic color-inducing current may be provided by by-passing AND gate 200 and applying the periodic conduction signal directly to the input terminal of OR gate 192.

With the arrangement stated above, the driver circuit consumes little energy and makes it possible to drive an electrochromic display device in a manner such that digits appear clear and distinct. The driver circuit as herein disclosed may also be employed as an integrated circuit and is thus applicable to electronic timepieces.

What is claimed is:

1. A driver circuit for an electrochromic display device having segment electrodes and a common electrode adapted to display information in response to a display information signal, comprising:

storage means for storing said display information signal and generating first and second output signals delayed in phase from said display information signal;

means for generating a bleaching signal in response to said first output signal and said display information signal;

means for generating a coloration signal in response to said second output signal and said display information signal;

first switching means coupled to each of said segment electrodes and conductive in response to said bleaching signal to cause an electric current to flow through said each of said segment electrodes in a direction to induce bleaching;

second switching means coupled to said each of said segment electrodes and conductive in response to said coloration signal to cause an electric current to flow through said each of said segment electrodes in a direction to induce coloration; and means for generating an auxiliary signal to cause a display segment corresponding to said each of said segment electrodes to remain in its previously activated state for an extended period of time.

2. A driver circuit for an electrochromic display device having segment electrodes and a common electrode adapted to display information in response to a display information signal, comprising:

storage means for storing said display information signal and generating first and second output signals delayed in phase from said display information signal;

means for generating a bleaching signal in response to said first output signal;

means for generating a coloration signal in response to said second output signal;

first switching means coupled to each of said segment electrodes and conductive in response to said bleaching signal to cause an electric current to flow through said each of said segment electrodes in a direction to induce bleaching;

second switching means coupled to said each of said segment electrodes and conductive in response to said coloration signal to cause an electric current to flow through said each of said segment electrodes in a direction to induce coloration; and means for generating an auxiliary signal to cause a display segment corresponding to said each of said segment electrodes to remain in its previously activated state for an extended period of time, wherein said bleaching signal generating means comprises a NAND gate having one input coupled to receive said first output signal and another input coupled via an inverter to receive said display information signal.

3. A driver circuit according to claim 2, in which said coloration signal generating means comprises an AND gate having one input coupled to receive said second output signal and another input coupled to receive said display information signal.

4. A driver circuit for an electrochromic display device having segment electrodes and a common electrode adapted to display information in response to a display information signal, comprising:

storage means for storing said display information signal and generating first and second output signals delayed in phase from said display information signal;

means for generating a bleaching signal in response to said first output signal;

means for generating a coloration signal in response to said second output signal;

first switching means coupled to each of said segment electrodes and conductive in response to said bleaching signal to cause an electric current to flow through said each of said segment electrodes in a direction to induce bleaching;

second switching means coupled to said each of said segment electrodes and conductive in response to said coloration signal to cause an electric current to flow through said each of said segment electrodes in a direction to induce coloration; and means for generating an auxiliary signal to cause a display segment corresponding to said each of said segment electrodes to remain in its previously activated state for an extended period of time, wherein said first switching means comprises a P-channel metal oxide semiconductor field-effect transistor having its source terminal coupled to the positive potential side of a power supply and its gate terminal coupled to said bleaching signal generating means, and in which said second switching means comprises an N-channel metal oxide semiconductor field-effect transistor having its source terminal coupled to the negative potential side of said power supply and its gate terminal coupled to said coloration signal generating means, drain terminals of said P-channel and N-channel metal oxide semiconductor field-effect transistors being coupled together and connected to said each of said segment electrodes and said power supply comprises first and second batteries and said common electrode is coupled between the negative terminal of said first battery and the positive terminal of said second battery and connected to ground.

5. A driver circuit for an electrochromic display device having segment electrodes and a common electrode adapted to display information in response to a display information signal, comprising:

storage means for storing said display information signal and generating first and second output signals delayed in phase from said display information signal;

means for generating a bleaching signal in response to said first output signal;

means for generating a coloration signal in response to said second output signal;

first switching means coupled to each of said segment electrodes and conductive in response to said bleaching signal to cause an electric current to flow through said each of said segment electrodes in a direction to induce bleaching;

second switching means coupled to said each of said segment electrodes and conductive in response to said coloration signal to cause an electric current to flow through said each of said segment electrodes in a direction to induce coloration; and means for generating an auxiliary signal to cause a display segment corresponding to said each of said segment electrodes to remain in its previously activated state for an extended period of time, said auxiliary signal generating means comprises means for detecting a bleaching indicative state of said display information signal to generate said auxiliary signal in response thereto, and switching means conductive in response to said auxiliary signal to cause said each of said segment electrodes and said common electrode to be short-circuited.

6. A driver circuit according to claim 5, in which said detecting means comprises a NAND gate having one input coupled to an output of said bleaching signal generating means and another input coupled to receive said display information signal via an inverter.

7. A driver circuit according to claim 5, in which said switching means of said auxiliary signal generating means comprises a P-channel metal oxide semiconductor field-effect transistor having its gate terminal coupled to receive said auxiliary signal, a source terminal coupled to ground, and a drain terminal coupled to said each of said segment electrodes.

8. A driver circuit for an electrochromic display device having segment electrodes and a common electrode adapted to display information in response to a display information signal, comprising:

storage means for storing said display information signal and generating first and second output signals delayed in phase from said display information signal;

means for generating a bleaching signal in response to said first output signal;

means for generating a coloration signal in response to said second output signal;

first switching means coupled to each of said segment electrodes and conductive in response to said bleaching signal to cause an electric current to flow through said each of said segment electrodes in a direction to induce bleaching;

second switching means coupled to said each of said segment electrodes and conductive in response to said coloration signal to cause an electric current to flow through said each of said segment electrodes in a direction to induce coloration; and means for generating an auxiliary signal to cause a display segment corresponding to said each of said segment electrodes to remain in its previously activated state for an extended period of time, wherein said storing means comprises a first latch circuit having its data terminal coupled to receive said display information signal, a clock terminal coupled to receive a clock signal, a first output on which said first output signal appears and a second output, and a second latch circuit having its data terminal coupled to the first output of said first latch circuit, a clock terminal coupled to receive said clock signal via a first inverter and an output on which said second output signal appears.

9. A driver circuit according to claim 8, in which said bleaching signal generating means comprises an AND gate having one input coupled to the first output of said first latch circuit and another input coupled to receive said display information signal via a second inverter to generate said bleaching signal, and in which said coloration signal generating means comprises an AND gate having its one input coupled to the output of said second latch circuit and another input coupled to the first output of said first latch circuit to generate said coloration signal.

10. A driver circuit according to claim 8, in which said common electrode is coupled to receive said clock signal through third and fourth inverters.

11. A driver circuit according to claim 8, in which said auxiliary signal generating means comprises means for detecting a bleaching indicative state of said display information signal to generate an output signal in response thereto, and gate means responsive to said output signal from said detecting means for generating said auxiliary signal composed of a first train of pulses and a second train of pulses, said first and second switching means being responsive to said first and second trains of pulses, respectively, whereby said each of said segment electrodes is alternately coupled to the positive and negative potential sides of said power supply such that said each of said segment electrodes and said common electrode are short-circuited.

12. A driver circuit according to claim 11, in which said detecting means comprises an AND gate having one input coupled to receive said display information signal via said second inverter and another input coupled to the second output of said first latch circuit.

13. A driver circuit according to claim 12, in which said gate means comprises a first AND gate having one input coupled to receive said clock signal and another input coupled to an output of said AND gate of said detecting means, a NOR gate having its one input coupled to an output of said first AND gate and another input coupled to an output of said AND gate of said bleaching signal generating means, a second AND gate having its one input coupled to receive said clock signal via said first inverter and another input coupled to the output of said AND gate of said detecting means, and an OR gate having its one input coupled to an output of said AND gate of said coloration signal generating means and another input coupled to an output of said second AND gate.

14. A driver circuit according to claim 10, in which said auxiliary signal generating means comprises means for detecting a bleaching indicative state of said display information signal and generating said auxiliary signal composed of a train of pulses to cause said each of said segment electrodes and said common electrode to be periodically short-circuited.

15. A driver circuit according to claim 14, in which said detecting means comprises an AND gate having a first input coupled to receive said display information signal through said second inverter, a second input coupled to receive said clock signal, and a third input coupled to the second output of said first latch circuit.

16. A driver circuit according to claim 15, in which said auxiliary signal generating means further comprises a NOR gate having its one input coupled to the output of said AND gate of said bleaching signal generating means and another input coupled to an output of said AND gate of said detecting means, said NOR gate having its output being coupled to said first switching means.

17. A driver circuit according to claim 15, in which said auxiliary signal generating means further comprises an OR gate having its one input coupled to the output of said AND gate of said detecting means and another input coupled to the output of said AND gate of said coloration signal generating means, said OR gate having its output coupled to said second switching means.

18. A driver circuit for an electrochromic display device having segment electrodes and a common electrode adapted to display information in response to a display information signal, comprising:

storage means for storing said display information signal and generating first and second output signals delayed in phase from said display information signal;

means for generating a bleaching signal in response to said first output signal;

means for generating a coloration signal in response to said second output signal;

first switching means coupled to each of said segment electrodes and conductive in response to said bleaching signal to cause an electric current to flow through said each of said segment electrodes in a direction to induce bleaching;

second switching means coupled to said each of said segment electrodes and conductive in response to said coloration signal to cause an electric current to flow through said each of said segment electrodes in a direction to induce coloration; and means for generating an auxiliary signal to cause a display segment corresponding to said each of said segment electrodes to remain in its previously activated state for an extended period of time, said auxiliary signal generating means comprises gate means coupled between said storing means and said bleaching signal generating means and responsive to an erase signal for generating said auxiliary signal, said bleaching signal generating means being responsive to said auxiliary signal to generate an additional bleaching signal whereby said first switching means is rendered conductive to connect said each of said segment electrodes to a power supply to cause an electric current to flow in a direction to maintain said segment in its bleached state for an extended period of time.

19. A driver circuit according to claim 18, in which said gate means comprises an OR gate having its one input coupled to receive said first output signal, another input coupled to receive said erase signal, and an output coupled to said bleaching signal generating means.

20. A driver circuit for an electrochromic display device having segment electrodes and a common electrode adapted to display information in response to a display information signal, comprising;

storage means for storing said display information signal and generating first and second output signals delayed in phase from said display information signal;

means for generating a bleaching signal in response to said first output signal;

means for generating a coloration signal in response to said second output signal;

first switching means coupled to each of said segment electrodes and conductive in response to said bleaching signal to cause an electric current to flow through said each of said segment electrodes in a direction to induce bleaching;

second switching means coupled to said each of said segment electrodes and conductive in response to said coloration signal to cause an electric current to flow through said each of said segment electrodes in a direction to induce coloration; and means for generating an auxiliary signal to cause a display segment corresponding to said each of said segment electrodes to remain in its previously activated state for an extended period of time, said auxiliary signal generating means comprises gate means coupled between said storing means and said coloration signal generating means and responsive to a control signal for generating said auxiliary signal, said coloration signal generating means being responsive to said auxiliary signal to generate an additional coloration signal to cause said second switching means to connect said each of said segment electrodes to a power supply to maintain said segment in its previously colored state for an extended period of time.

21. A driver circuit according to claim 20, in which said gate means comprises an OR gate having its one input coupled to receive said second output signal, another input coupled to receive said control signal, and an output coupled to said coloration signal generating means.

* * * * *